US007128108B2

(12) United States Patent
Nielsen

(10) Patent No.: US 7,128,108 B2
(45) **Date of Patent: *Oct. 31, 2006**

(54) CLOSEABLE SELF-VENTING SPOUT

(75) Inventor: Roger B. Nielsen, Meridian, ID (US)

(73) Assignee: NITEC—Nielsen Idaho Tool and Engineering Corp., Meridian, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/286,210

(22) Filed: Nov. 23, 2005

(65) Prior Publication Data

US 2006/0076082 A1 Apr. 13, 2006

Related U.S. Application Data

(63) Continuation of application No. 10/693,211, filed on Oct. 23, 2003, now Pat. No. 6,968,875.

(51) Int. Cl.
*B65B 1/04* (2006.01)

(52) U.S. Cl. ..... 141/351; 141/301; 141/350

(58) Field of Classification Search ..... 141/2, 141/4, 7, 59, 67, 94, 192, 198, 285–291, 141/301, 302, 350–354; 222/566–571, 484, 222/514, 518, 525

See application file for complete search history.

(56) References Cited

U.S. PATENT DOCUMENTS

| | | | | |
|---|---|---|---|---|
| 2,963,205 | A | 12/1960 | Beall, Jr. | |
| 3,606,096 | A | 9/1971 | Campbell | |
| 4,105,148 | A | 8/1978 | Williams | |
| 4,598,743 | A | 7/1986 | Milling | |
| 4,667,710 | A | 5/1987 | Wu | |
| 4,802,610 | A | 2/1989 | Cheek et al. | |
| 4,834,151 | A | 5/1989 | Law | |
| 5,076,333 | A | 12/1991 | Law | |
| 5,107,909 | A | 4/1992 | Donovan | |
| 5,249,611 | A | 10/1993 | Law | |
| 5,507,328 | A | 4/1996 | Donovan | |
| 5,628,352 | A | 5/1997 | Gracyalny et al. | |
| 5,641,099 | A | 6/1997 | McLelland et al. | |
| 5,704,408 | A | 1/1998 | Law | |
| 5,762,117 | A | 6/1998 | Law | |
| 6,155,464 | A | 12/2000 | Vachon | |
| 6,186,375 | B1 | 2/2001 | Chrisco et al. | |
| 6,227,419 | B1 | 5/2001 | Raboin | |
| 6,397,902 | B1 | 6/2002 | Murphy | |
| 6,435,380 | B1 | 8/2002 | Raboin | |
| 6,478,058 | B1 | 11/2002 | Pears | 141/353 |
| 6,871,680 | B1 | 3/2005 | Trippi, Jr. | 141/350 |
| 6,889,732 | B1 | 5/2005 | Allen | 141/353 |
| 6,968,875 | B1 * | 11/2005 | Nielsen | 141/351 |

(Continued)

*Primary Examiner*—Steven O. Douglas
(74) *Attorney, Agent, or Firm*—Pedersen & Co., PLLC; Ken J. Pedersen; Barbara S. Pedersen

(57) ABSTRACT

A non-spilling detachable pouring spout configured to transfer liquid from a non-vented filling container to a receiving container. This spout having a spout body defining an open passageway extending from an open first end to an open second end this open passageway having a generally tubular shaped hollow inner conduit positioned within the first hollow passageway, and defining a second hollow passageway. An intermediate sleeve is configured for attachment to the device and is further configured to seal against portions of the spout body and the inner conduit so as to variously control the flow of materials out of the spout body. The movement of said sleeve is controlled by movement of a child resistant sheath.

21 Claims, 8 Drawing Sheets

U.S. PATENT DOCUMENTS

2002/0074365 A1 6/2002 Young
2002/0074366 A1 6/2002 Young
2003/0034363 A1 2/2003 Morgenroth
2003/0066850 A1 4/2003 Young

* cited by examiner

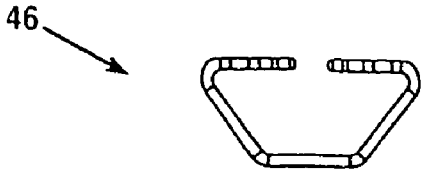
FIG. 7 A
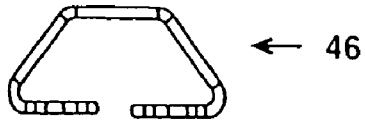
FIG. 7 B
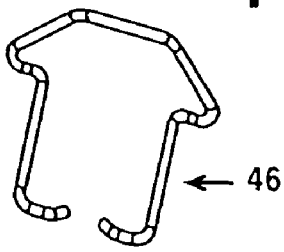
FIG. 7 C
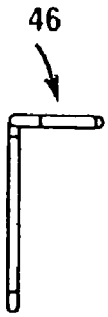
FIG. 7 D
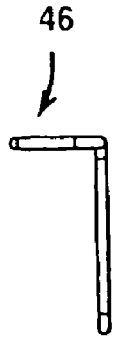
FIG. 7 F
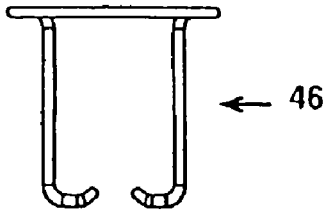
FIG. 7 E
FIG. 7

CLOSEABLE SELF-VENTING SPOUT

DESCRIPTION

This is a continuation of, and claims priority from, U.S. patent application Ser. No. 10/693,211, filed Oct. 23, 2003, entitled Closeable Self-Venting Spout, issuing as U.S. Pat. No. 6,968,875 on Nov. 29, 2005.

BACKGROUND OF THE INVENTION

1. Field of the Invention

The present invention generally relates to detachable pouring spouts that are configured to transfer the contents of a filling container to a receiving container. More particularly, the present invention relates to a detachable self-venting, non-spilling pouring spout, which can be selectively opened and closed when attached to a filling container. In the preferred embodiment, the present invention is a selectively openable self-venting child-resistant spout that allows for smooth transfer of liquid materials from a non-vented holding container to a receiving container.

2. Background Information

Many products are stored in one container, but must be transferred to another container for use. An example of such a product is gasoline, which may be stored in a variety of differently configured containers, but which in order to be used must be transferred to a refillable holding tank that is connected to an internal combustion engine. For instance, a typical homeowner who owns a lawnmower, snow blower, or other such device that is powered by a small gasoline engine would typically have a storage container filled with gasoline. In order to use any of these gasoline powered devices, gasoline must be transferred from the storage container into the holding tank of the engine. In order to perform this task, the gasoline would have to be transferred from the storage container to the gas holding tank, which is located upon the device.

One way that this is accomplished is by pouring the gasoline or other material from the storage container into another container. In the process of pouring this material from one container into another, a variety of problems arise. One problem is that the size of the opening in the filling container may not be compatible with the size of the opening on the receiving container. As a result, the material being transferred may splash or flow over the outer portions of the container being filled. When this occurs, the spilled material is not only wasted but a variety of damaging effects to persons and things in the surrounding area can also occur. For example, spilled gasoline raises a variety of concerns of safety to both the environment and the individual. Spilled gasoline emits fumes, which can be hazardous both from their inhalation as well as for the increased risk of flammability. Furthermore, the substances themselves may have a variety of damaging effects upon the surrounding environment.

In order to limit these effects, a variety of spouts and nozzles have been developed. However, these nozzles and spouts bring with them a variety of problems as well. One of the problems with many of these types of nozzles is their inability to allow for a smooth transfer of air into the container to replace the liquid that is leaving the container. As a result, a vacuum is formed within the filling container. This vacuum restrains the liquid from exiting the filling container. When sufficient pressure is built up, the vacuum is broken and liquid will surge forward out of the device. These surges can result in spills and overflow of material out of the device. The repetitive surging of air into the device and the surging exit of liquid out of the device can also cause a chugging or gurgling sound to occur. This chugging or gurgling makes filling a container to a desired level without spilling difficult because the quantity of material that will surge forward is unpredictable. This uneven flow can further contribute to spillage and/or over filling of the container.

Another problem with the prior art nozzles is that when utilizing such a nozzle, it is difficult to determine when the receiving container is full. As a result, an individual may continue to pour liquid into this container and cause the contents to overflow. Another problem that exists in the prior art is that access to these containers may be obtained by individuals such as small children, who may inhale the fumes or ingest the gasoline and suffer significant damaging effects.

Another problem that exists in the prior art is the necessity of O-rings as sealing devices. O-rings seal by simply overpowering the material that they are sealing against. As a result, O-rings place substantial static pressures upon the materials that make up the various spout pieces and can result in failure of the materials from which the spout is made. Additionally, over time the O-rings themselves may also wear out and be degraded by the chemicals that they are trying to seal. As a result, replacements are needed in order to provide the proper and adequate sealing properties. Another problem with such devices is that they can be prohibitively expensive to manufacture and produce.

Therefore, what is needed is a detachable pouring spout that can be selectively opened and closed to allow the free, smooth flow of liquid from a filling container into a receiving container. What is also needed is a device that can be solidly constructed to allow the transfer of liquid from one container to another without the use of O-rings as a part of the sealing device. What is also needed is a spout that provides the aforementioned features that also provides a child resistant locking device to prevent unwanted access to the container by children, while remaining consumer friendly and usable by persons of varied physical capabilities and ages.

Accordingly, it is an object of the invention to provide a spout that allows for regular flow of material through a selectively openable valve system that is formed within a portion of the spout. Another object of the invention is to provide a spout that provides for increased safety in the use of a self-venting pouring spout. Another object of the invention is to provide a closable spout of sufficient length and shape to give free access between the opening in the receiving tank and the filling tank. Another desired feature is to provide a spout that can connect with a filling container that has a sealing portion as an integral portion of the spout and that does not utilize an O-ring seal. Another object of the invention is to provide a valved self-venting spout that provides a suitable configuration for shipping, including a device that could be configured to be inserted in an inverted direction within a typical gas can type storage container. A further object of the invention is to provide a spout having the ability to easily release excessive container pressure prior to use. Accordingly, it is an object of the invention to provide all of the features listed above.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a detachable self-venting pouring spout that is configured for connection with a non-vented filling container. The spout has a single one-piece tube that is configured to form a spout body. The spout body extends from an open spout first end to an open spout second end. The spout body second end is configured to connect with a nozzle end connection. The spout body further defines a first hollow passageway that extends from the spout body first end to the spout body second end.

A generally hollow tubular shaped inner conduit is configured to be positioned within the first hollow passageway. The inner conduit extends from an open conduit first end positioned near the spout body first end to an open conduit second end that is positioned near the spout body second end. The inner conduit defines a second hollow passageway therein. The inner conduit second end is further configured to receive a biasing spring and a portion of an intermediate sleeve therein. The intermediate sleeve is configured to extend from an open intermediate sleeve first end to an open intermediate sleeve second end. The intermediate sleeve defining a third hollow passageway between the open intermediate sleeve first end and the open intermediate sleeve second end.

The second end of the intermediate sleeve further comprises a generally circular shaped flare that is configured to form a sealing connection with a compatibly configured portion of the nozzle end. The intermediate sleeve first end is configured to be slide ably inserted within the inner conduit second end. The slideable sleeve second end configured to be slideably positioned within a portion of the nozzle end portion.

The nozzle end portion has a nozzle end body, an open nozzle first end configured to connect with the spout body second end, and an open nozzle second end configured for placement within a receiving container. The open nozzle second end further comprises a generally crescent shaped partition. The generally crescent shaped partition runs along the length of the nozzle end portion and is configured to define an airflow chamber and a liquid flow chamber within the nozzle end. The partition further comprises a stopper configured to interact with a portion of the campanulate shaped portion of the inner sleeve so as to prevent the passage of air through the nozzle, when the stopper is positioned against an inner portion of the intermediate sleeve.

The intermediate sleeve is configured to slide within the spout body and the nozzle end. Depending upon the position of the sleeve, the flow of material out of the device may be controlled between a fully closed position wherein no fluid may pass out of the nozzle and a fully opened position wherein the flow of fluid out of the container and the flow of air into the container are maximized. The intermediate sleeve is also connected to a sliding clip that is configured to move the sliding sleeve in a variety of desired positions. The sliding clip is configured for connection with and placement within an outer sheath. The outer sheath is configured to interact with portions of the outer surface of the spout body to prevent the sliding clip from moving unless the outer sheath is twisted in a desired orientation. This configuration prevents the opening of the spout by persons such as small children, who lack the ability or comprehension to twist and slide the outer sheath in order to open the spout.

In use, the spout is connected to an outlet portion of a non-vented filling container. The shape of the spout body is configured to connect with an opening portion of a storage container so as to provide a generally leak proof seal. A portion of the inner conduit extends into a non-vented filling container to a position adequate to control relief of a vacuum as it forms. A biasing spring keeps the generally campanulate portion of the inner sleeve in a sealing connection against a portion of the nozzle end, and against the stopper end of the partition. This connection prevents the flow of air into the filling container through the inner conduit as well as preventing the flow of liquid out of the container through the portions of the spout body that form chambers around the inner conduit (vent tube).

When the outer sheath is moved in a direction toward the storage container, the sliding clip engages the extension portions of the inner sleeve and pushes the inner sleeve back against the biasing spring. When the biasing spring is sufficiently compressed, a channel opens between the portions of the spout body and the portions of the nozzle end. The configuration of the nozzle end and the inner sleeve interact to form a telescoping partition, which maintains an airflow channel and a liquid flow channel separate. When opened these channels allow for the flow of air into the storage container through the air passageway and the flow of liquid out of the storage container through the spout body of the liquid flow chamber. Additionally, when utilizing the device for the first time, the action of opening the valve vents the nozzle and allows built up vapors and gasses to be dissipated.

As the inner sleeve is progressively moved backward toward the storage device, the size of the openings for the flow of air into the filling container as well as the flow of liquid out of the device are progressively increased. As a result, the exchange of air into the container and flow of liquid out of the container is accomplished in a smooth manner without the gurgling and surging problems that are associated with prior art nozzles.

The venting system, as incorporated in the new spout, bypasses the problem of the vent system function found in other devices found in the prior art. In the present invention, the combination of an air venting system and a liquid flow passageway that are separated one from another allow the fluids that are positioned within the container to exit downward through the spout and to flow smoothly without gurgling or surging as may occur in the prior art embodiments.

The present invention is configured so that the air vent tube is positioned so as to allow the passage of air through the air vent tube up into the container to replace the liquid that passes out of the container through the liquid flow passageway. The liquid flow passageway is configured to receive a greater volume of material than the air flow passageway. The liquid flow passageway is also configured to be positioned lower than the open end of the air vent tube when the filling container is inverted into a vertical position. The fluid flow passageways are larger nearest the open end of the spout that are connected to the container, and decrease in size to a smaller diameter further down along the length of the spout body.

This configuration draws upon the force of gravity to pull liquid down through the spout while providing a separate tube and opening that is placed in the container to be filled with the liquid. In use, the spout is put in place; the container is inverted and the valve slid into an open position. When this occurs, the force of gravity pulls the liquid downward through the liquid flow passageway spout and into the container to be filled. As this liquid enters into the container, the air is displaced from the container being filled and passes upward into the airflow passageway of the spout. The airflow passageway delivers the air through an airflow passageway, which is separate from the liquid flow passageway, up and into the filling container.

The opening of the airflow passageway within the filling container is vertically higher than the position of the liquid flow passageway within the same container. As a result, when the container is inverted, the liquid that is closest to the liquid flow passageway exits the container first. When this occurs, the air is enabled to flow through the airflow passageway up and into the filling container at a location that is past the level of equalization between the liquid and the air. Because the air vents higher into the filling container than the draining position from whence the liquid flows, the air and the liquid do not interface nor do they block the flow of one another. As a result so-called pressure plugs do not form and the flow of material into and out of the device is smooth.

The smoothness of the flow of air into the filling container and the flow of liquid out of the container is further enhanced by sequentially reducing the dimensions of the fluid flow passageway, as the passageway extends away from the filling container. While also increasing the dimensions of the airflow passageway as the airflow passageway ends away from the filling container. This configuration ensures that an air bubble will exist at a location in the vent tube that is higher than liquid that is positioned in the full diameter of the fluid in the liquid flow chamber. In the present invention, the fluid flow passageway is configured so as to have a larger first portion positioned closest to the first end of the spout and to decrease in size so as to define a passageway having a smaller diameter and therefore able to hold a lesser volume of material thereafter. This volumetric change concentrates the gravitational pressure upon the fluid column at the joint or elbow of the device and allows the internal air bubble to rise above the fluid level. This variation in size slows the rate at which liquid will exit the device and allows the rate at which air enters the filling device to be greater than the rate at which liquid leaves this same container. As a result, sufficient air to replace exiting liquid is always present and the problems of chugging and surging, which exist in the prior art, are done away with.

The configuration of the sliding sleeve allows for the air flow and the liquid flow chambers to be effectively telescoped in length, as the device is moved between an open and a closed position. Thus, allowing the venting system and the liquid flow chambers to be maintained separately and preventing the problems of vacuum formation, surging, and chugging which are found in the prior art. The sliding sleeve works with portions of the end nozzle in a sliding type configuration which allows the apertures to be alternatively opened and closed, while still allowing the flow of air and the flow of liquid out of the device to be alternatively stopped or started.

When the sliding sleeve is brought into compression against the sides of the end nozzle, and the stopper is placed in a designated location against an inner portion of the sliding sleeve, the flow of liquid material out of the device is stopped. However, when the engagement between the sliding sleeve and the side of the end nozzle is relaxed, the flow of material through the device occurs. When the sliding sleeve is opened, a venturi effect caused by the passing flow of liquid and air is created and on the exiting fluid flow is created and the air and fluid are prevented from mixing. The combination of these features delivers unimpeded air to the vent tube near the filling container neck and does away with the gurgling, surging and splashing that are found in the prior art.

When the spout is first placed upon the device and the container is inverted. Liquid will fill both the airflow and liquid flow passageways. However, when the device is opened, the venturi effect, which is brought about by the variations in the dimensions of the spout, causes the liquid that is within the air flow passageway to rapidly evacuated from the air flow passageway and to be rapidly replaced with air. Once the flow of air through the airflow passageway has been established, the physical structure of the spout maintains the separation between the flow of air and liquid in opposite directions through the spout.

The present invention also provides a significant advantage in that it eliminates the use of O-rings to seal the device, thus reducing manufacturing costs, and the number of device failures. The shape of the various pieces within the device are self nesting and self sealing thus allowing the parties involved in the manufacture of such devices to reduce manufacturing costs. This venting system is fully internally self-contained. Any erratic fluid behaviors can be controlled internally and does not expose consumers or equipment to wayward sprays or gurgles.

The present invention has a child resistant flange connected to the outer sheath. In the valve-closed position, the slide is free from any demanding contacts. When the valve opening is desired, spring features are engaged to act on the slide in both a radial and linear manner. Turning the sheath will disengage the child resistant feature allowing the slide to be pulled back in a linear direction down the length of the spout. With a slight delay, as the movement passes the child resistant feature, the internal face of the sheath flange engages the wire clip slide clip, which pushes back the sliding sleeve. This action can be accomplished either by the consumer or by twisting the outer sheath to the hold position, inverting the container, and pushing the flange of the spout against the lip of the receiving container, which would then open the spout.

The design of the tip end of the present invention is self-evacuating upon valve closure. After the receiving tank has reached capacity, lifting the portable container allows the internal biasing spring to act on the sliding sleeve to return the tank to its closed and safe position. The face of the outer sheath will remain in contact with the lip of the receiving tank until the valve is sealed, at which time contact between the tank and the outer sheath will be broken as the container spout continues to be lifted out of the receiving tank. The tip of the spout will break the fluid surface level of the receiving tank and instantly self-evacuate because the vent tube channel is filled with air and is exposed to the top of the remaining fluid inside the tip of the spout.

Further, the purpose of the foregoing abstract is to enable the United States Patent and Trademark Office and the general public, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

BRIEF DESCRIPTION OF THE DRAWINGS

FIGS. 7A–7F are views of the sliding clip from a variety of perspectives.

DESCRIPTION OF THE PREFERRED EMBODIMENTS

Figure 1:
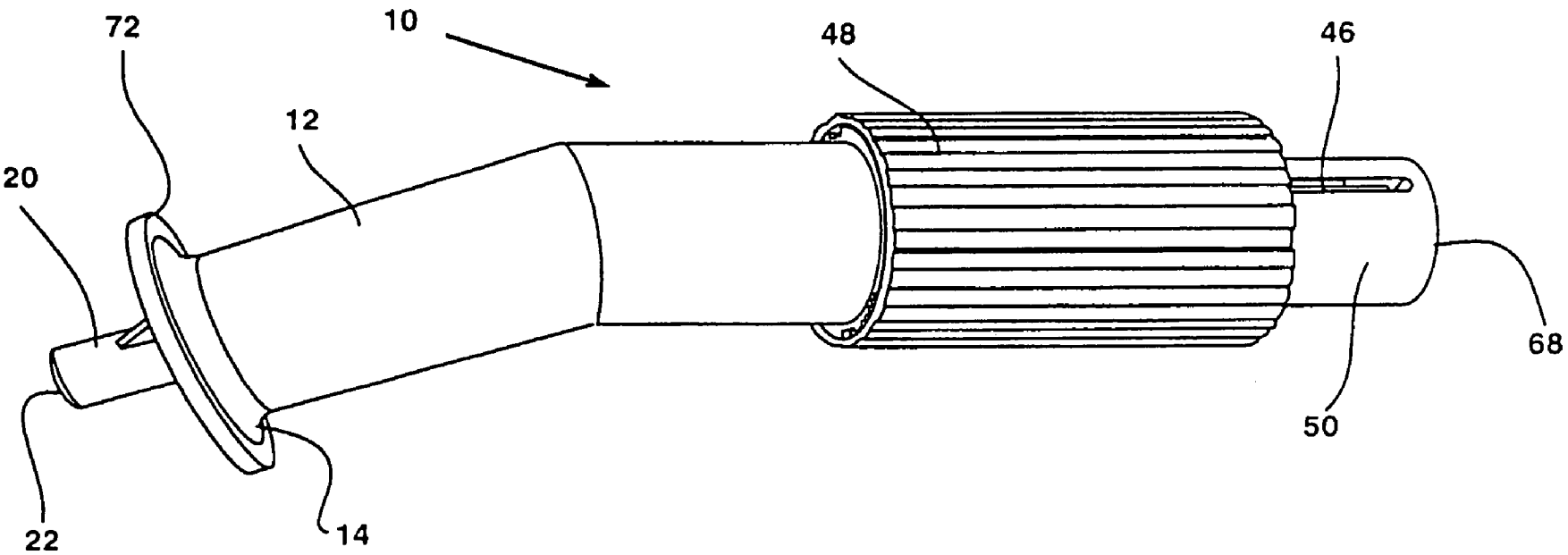
FIG. 1 is a side view of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIG. 1 shows a side view of the present invention. The present invention is a spout 10 comprised of a spout body 12 having a first end 14 extending along a length to a second end 16 (shown in FIGS. 2, 3 and 4). The first and second ends 14, 16 of the spout body are open and define a spout body passageway 18 (shown in FIGS. 2, 3, 4) which extends from the first end 14 to the second end 16. In this preferred embodiment, the angle between the first and second ends 14, 16 is configured to extend at oblique angle of about 150 degrees. However, it is to be distinctly understood that this configuration is not limiting but merely illustrative.

The spout body 12 is configured to receive an inner conduit 20, which extends from a portion beyond the first end of the spout body 14 through the spout body passageway 18 (shown in FIG. 2) defined within the spout body 12. The inner conduit 20 is configured to extend to a location within the filling container beyond where the pressure of fluid entering and exiting the container is roughly equivalent. This general level of opposing pressures, referred to hereinafter as the level of equalization, has a generally flattened parabolic shape. This shape represents the general level of equalization between the pressure of the liquid attempting to exit the device created by gravity and the pressure pressing against the liquid created by the vacuum in the sealed container. The inner conduit 20 is positioned so that the inner conduit first end 22 passes through this level of equalization and allows the flow of air into a storage container from which material is sought to be removed. In a preferred embodiment, this overall length of the conduit 20 is typically less than three inches, of which about ⅝" extends into the container past the level of equalization. However, it is to be distinctly understood that this distance may be varied depending upon a variety of other factors.

The spout body 12 extends to a connection with a nozzle end connection 50. The nozzle end connection 50 is connected to the second end 16 of the spout body 12. A sliding clip 46 is configured for connection with a sliding sleeve 28, and portions of the end piece 50. These items are show in detail in FIG. 2. An outer sheath 48 is configured for selective adjustable connection with a portion of the spout body 12, and with a portion of the sliding clip 46. In use, the outer sheath 46 can be twisted and slid along a portion of the spout body 12. When this occurs, the sliding clip 46 is moved back towards the first end of the spout body 14, the inner sealing sleeve 28 (shown in FIG. 2) is moved and material is then able to flow out of the device in a smooth and controlled manner.

The nozzle end 50 has an end portion 68 that is open to allow the passage of fluid through the internal passageway of the spout body and out through the nozzle end 50. In a preferred embodiment, the diameter of this end portion 68 device is 0.8" and the diameter is configured to fit within a variety of types of containers. However, a variety of other dimensions may also be utilized depending upon the needs of the user.

As will be described further, in this preferred embodiment, this outer sheath 48 is configured to only selectively interact with the sliding clip 46 so as to provide a child resistant lock to prevent the sheath 48 from contacting the sliding clip 46 and allowing material to flow out of the device.

The first end of the spout body 14 is configured for connecting attachment with an open end of a non-vented filling container. Typically, such a container has an opening and a cap or lid which attaches to the container through a threaded type cap-connecting device. The first end of the spout body 14 is configured to form a seal with the opening portion of the container. The first end of the spout body 14 contains a sealing flange 72 that provides a generally smooth and flat surface that can interact with a lip portion of a container so that when combined with a standard type of gasket, a leak proof seal is provided. The connection between the nozzle 10 of the present invention and the storage container can then be held in place by appropriately tightening the nut or portion of the cap that is configured to interact with the threaded portions of the container.

Figure 2:
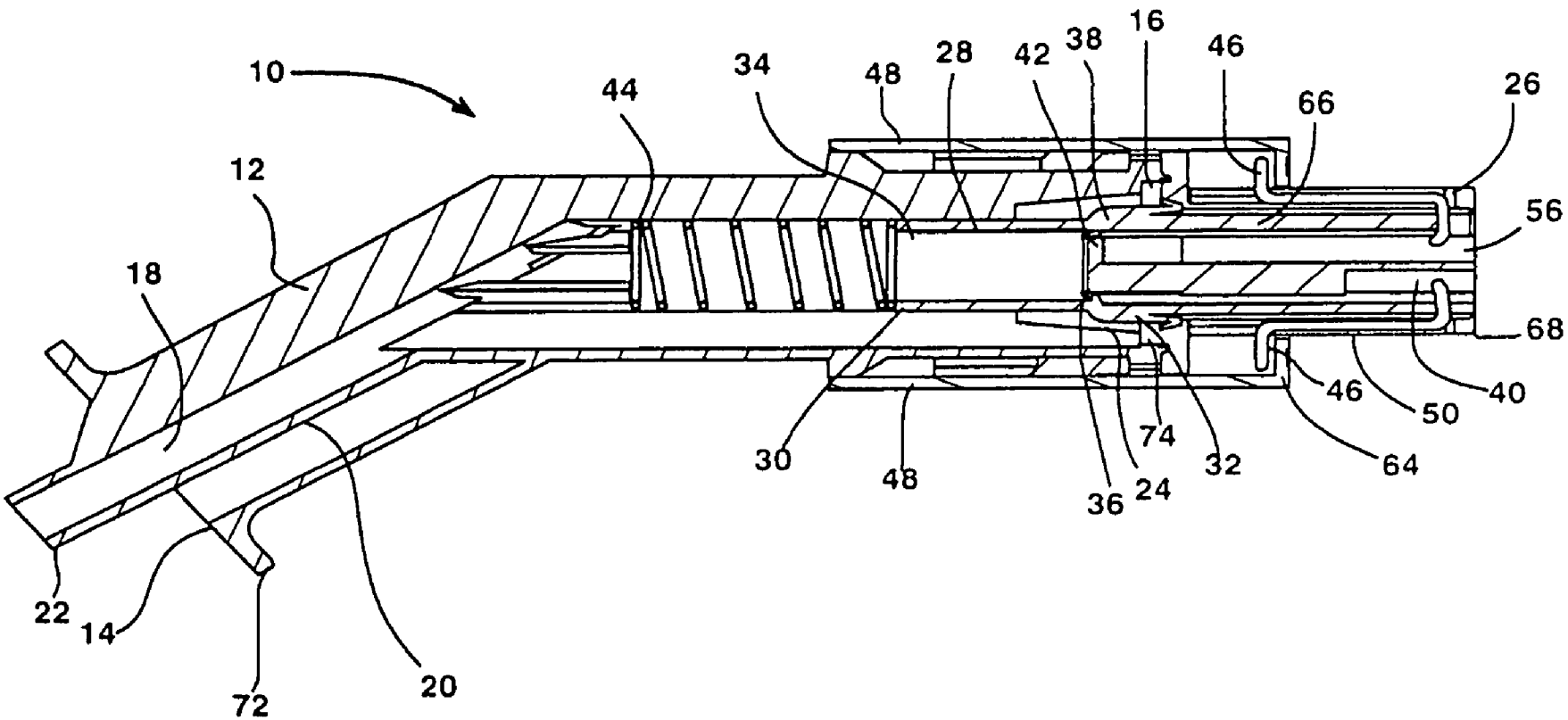
FIG. 2 is a cut away side view of the embodiment shown in FIG. 1 when the device is in a closed position.

Referring now to FIG. 2, a cutaway side view of the present invention in a closed position is shown. FIG. 2 shows a detailed side view of the present embodiment when the device is in a closed position. This figure shows the inner conduit 20 which extends from a first end 22 to a second end 24 within the spout body passageway 18. In this preferred embodiment, the inner conduit is comprised of two portions which intersect at the elbow portion of the vent tube 20 The spout body inner conduit 20 is configured to hold a biasing spring 44 that is configured to apply a designated amount of pressure upon an inner sealing sleeve 28.

The inner sealing sleeve 28 has a generally open first end 30 and extends to a generally open bell shaped or campanulate second end 32. This bell shaped second end 32 has a bell shaped outer portion 38 that is configured to interact with an inner sealing portion 74 to maintain a seal so as to prevent the flow of fluid material out of the nozzle end 50. This bell shaped second end 32 is also configured to interact with a stopper 42 so as to discourage the passage of air or fluid from the nozzle end connection 50 through the inner conduit 20 and into the storage container that is connected to the device.

The sealing sleeve 28 defines a sealing sleeve passageway 34, which is configured to allow air to flow from the nozzle end 50, through the sealing sleeve passageway 34, through the internal conduit 20, and into the storage container when the connection between the stopper 42 and the sealing sleeve 28 is relaxed. This combination of the internal conduit 20, sealing sleeve passageway 34, and a portion of the nozzle end 50 define an air flow passageway.

The inner conduit or vent tube 20 and the inner sleeve 28 are positioned within the spout body passageway 18. The spout body passageway 18 is defined by the spout body 12 and is configured to allow the flow of liquid out of the filling container through the spout body passageway 18 when the connection between the inner sealing sleeve 28 and the inner sealing portion 74 is relaxed. This spout body passageway 18 and a portion of the nozzle end 50 are defined as a liquid flow passageway.

The inner sealing sleeve 28 prevents the flow of liquid out of the device by compressive engagement of the bell shaped outer portions 38 of the sealing sleeve 28 against an inner sealing ridge 74 located within the nozzle end 50. This connection between the sealing ridge 74 and the bell shaped outer portion 38 of the sealing sleeve prevents the flow of liquid through the device. This connection between the bell shaped portions 38 of the sealing sleeve 28 and the inner sealing ridge 74 is maintained by pressure exerted by a biasing spring 44. This biasing spring 44 is configured to push inner sealing sleeve 28 up against the sealing ridge 74 and maintain the spout passageway 18 and the inner conduit 20 closed. This prevents the flow of liquid out of the device through the liquid flow passageway.

The bell shaped second end 32 of the inner sealing sleeve 28 is also held in an engaged position against the stopper 42 by the biasing spring 44. This prevents the flow of air through the sealing sleeve passageway 34 and the inner conduit 20, which make up the airflow passageway. In this closed position, the outer sheath 48 is not configured to engage any portion of the sliding clip 46. Therefore, the sliding clip 46 cannot engage the extension portions 66 of the sealing sleeve and the inner sealing sleeve 28 cannot be moved away from this closed position.

Figure 3:
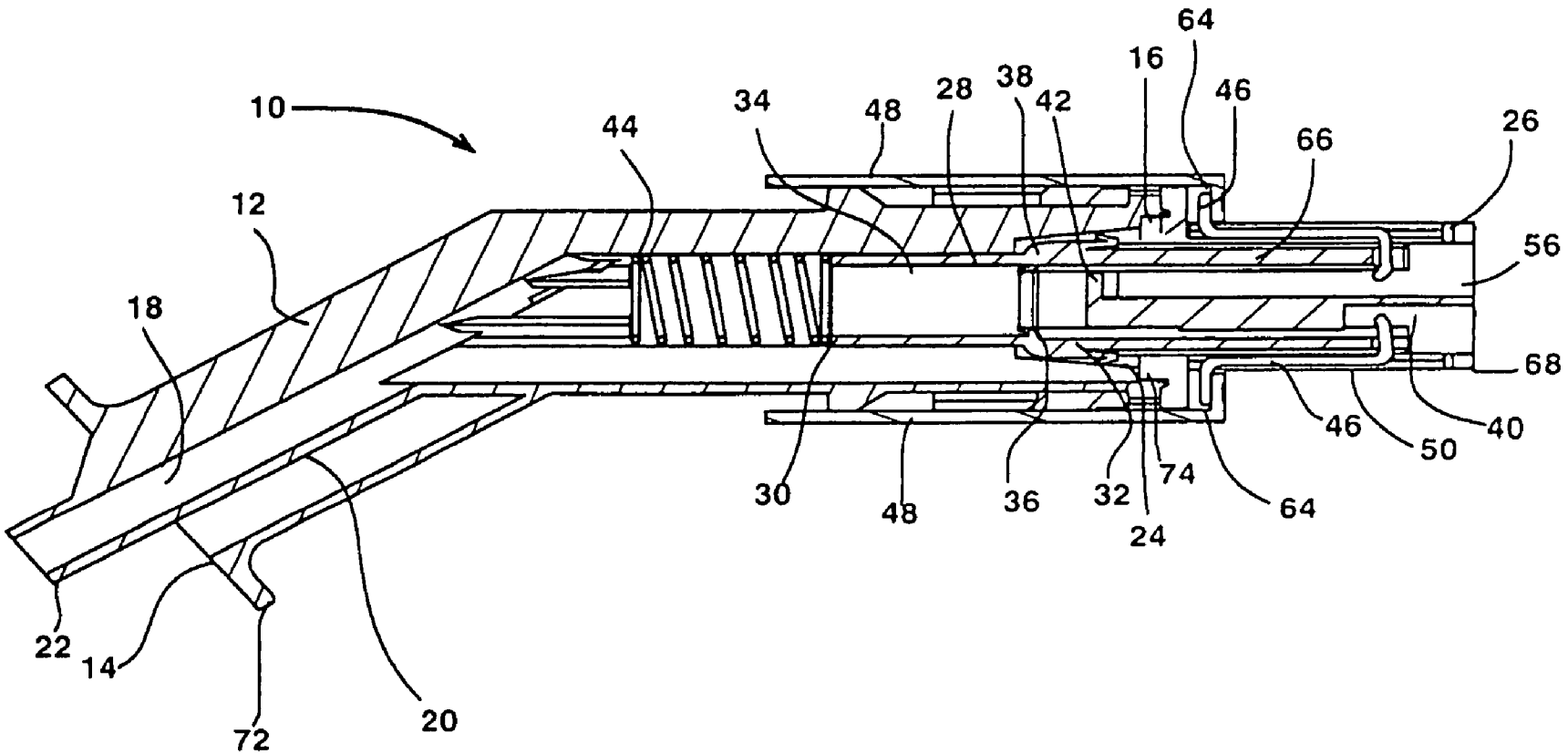
FIG. 3 is a cut away side view of the embodiment shown in FIG. 2 when the device is in an position.

Referring now to FIG. 3, shown is a detailed cutaway side view of the present invention in an open position. In this open position, a sufficient amount of pressure has been placed upon the biasing spring 44 so as to allow the campanulate shaped outer portions 38 of the sealing sleeve 28 to be removed from contact with the inner sealing portion 74, and the inner portions 36 of this bell shaped second end to be removed from contact with the stopper portion 42. When this occurs, air is able to flow from the second end 68 of the nozzle though a portion of the nozzle end 50, through the sealing seal passageway 34, through the inner conduit 20 and into the storage container. In addition, liquid is then able to flow from the storage container through the spout body passageway 18, through a portion of the nozzle end and out of the open nozzle end portion 68.

When the storage container is positioned in a filling position and removal of the liquid contents of the container is desired, the outer sheath 48 is positioned so as to prevent impediment by the child resistant features and the outer sheath 48 is pulled back. In the preferred embodiment, this is accomplished by twisting the outer sheath 48 and pulling the outer sheath 48 back towards the storage container. When this occurs, portions of the outer sheath 48 engage portions of the sliding clip 46. The sliding clip 46 then engages the extension portions 66 of the sealing sleeve 28 and force the sealing sleeve 28 back against the biasing spring 44. When this occurs, the seal that exists between the bell shaped valve sealing portion 38 and the inner sealing portions 74 and the stopper 42 is relaxed. When this occurs, airflow may flow from the second end 68 of the nozzle end connection 50, through the passageway 34, and the inner conduit 20 and into the filling container 20. This combined path is referred to as the airflow passageway for ease of simplicity. This same action also allows the flow of liquid from the filling container through the spout body passageway 18, the liquid flow portion of the nozzle end 50 and into the container being filled.

The configuration of the bell shaped outer portions 38 of the sleeve 28 discourages the passage of excess liquid into the airflow portions of the inner conduit 20 when the present invention is in use. The first end 22 of the inner conduit 20 extends sufficiently far into the container so as extend beyond a level of equalization between air and liquid that is created when a container is inverted into a pouring position. Throughout the length of the spout body 12 the inner conduit 20 which is configured to transfer air, and the passageway 18 defined by the spout body 12 which is configured to transfer liquid and maintain air and liquid in separate chambers. However, at the transition location between the spout body 12 and the nozzle end 50 this physical separation ends.

The bell-shaped portion 38 of the sleeve is configured to direct the flow of liquid from the liquid material passageways over the inner-sealing sleeve 28, and to maintain an opening within the sealing sleeve 28 so as to allow passage of air through the sealing sleeve passageway 34 and into the inner conduit 20. This configuration creates a venturi type of effect which encourages accumulated liquid to exit the sleeve hollow passageway 34, and the inner conduit 20 which are configured for the passage of air only. This configuration discourages the liquid and air portions from traveling in opposite directions within the same channel. This separation facilitates the transfer of liquid out of the device and the flow of air into the device; this further produces a smooth flow of liquid out of the storage container.

In order to place the device in the open position shown in FIG. 3, the outer sheath 48 must be adaptively twisted and slid to engage a sliding clip 46, which is configured to engage a portion of the sealing sleeve 28. When this occurs, the sealing sleeve 28 is pushed back against the biasing spring 44, compressing the biasing spring 44 and pushing the inner sleeve 28 apart from the stopper 42 and the inner sealing ridge 74. As shown in FIG. 3, when the device is in this position, air and liquid are configured to exchange and the liquid will flow appropriately through the device.

When pressure on the outer sheath is relaxed, the biasing spring 44 pushes the sealing sleeve 28 forward against the inner sealing portion 74 and the stopper 42. The flow of material into or out of the container is stopped. By limiting the amount of pressure applied against the biasing spring 44 the distance between the sealing sleeve 28 and the inner ridge 74 and the stopper 42 may be varied and thus the rate of flow of material out of the device controlled.

The device is configured so that the size of the aperture, through which liquid will flow, will decrease proportionately from a larger volume portion to a portion having a smaller portion. As a result, a smooth flow of air and liquid is maintained and gurgling or splashing of the liquid is reduced. This system provides a device and system for providing controlled smooth flow of liquid out of a filling container through a spout that has significant advantages over the devices available in the prior art. In addition, the slideable projections 66 on the slideable sleeve 28 interact with portions of the nozzle end to provide a telescoping channel that maintains a separation between the liquid leaving the nozzle and the air that is entering the nozzle. This embodiment is discussed in more detail in the paragraphs that describe FIG. 6.

Referring now to FIGS. 4–10, the configuration of the individual pieces of the preferred embodiment of the present invention are shown and described. While the configurations of the embodiments are disclosed, it is to be distinctly understood that the invention is not limited thereto, but that this disclosure is simply to be illustrative and not limiting and to set forth the best mode known for practicing the invention.

Figure 4:
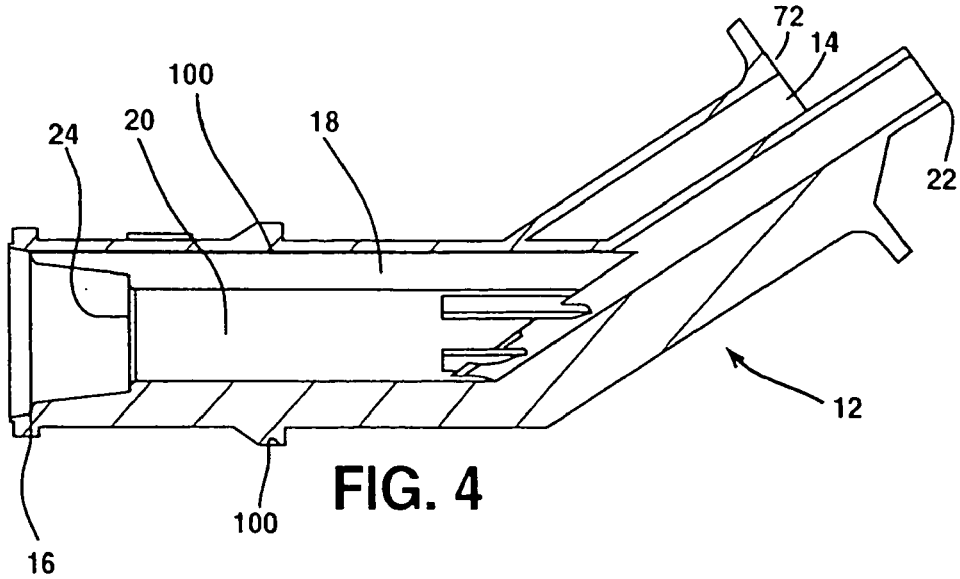
FIG. 4 is a cut away side view of the spout body portion of the invention.
Figure 4A:
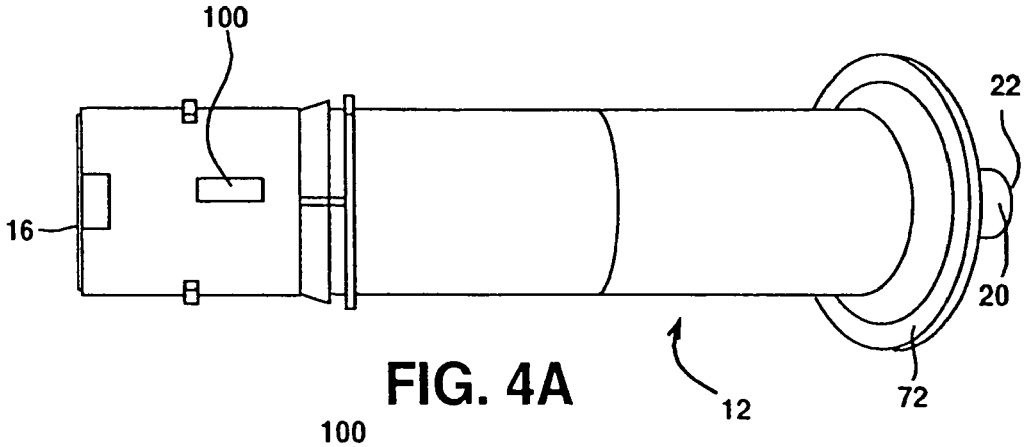
FIG. 4A is a top perspective view of the spout body portion of the present invention.
Figure 4B:
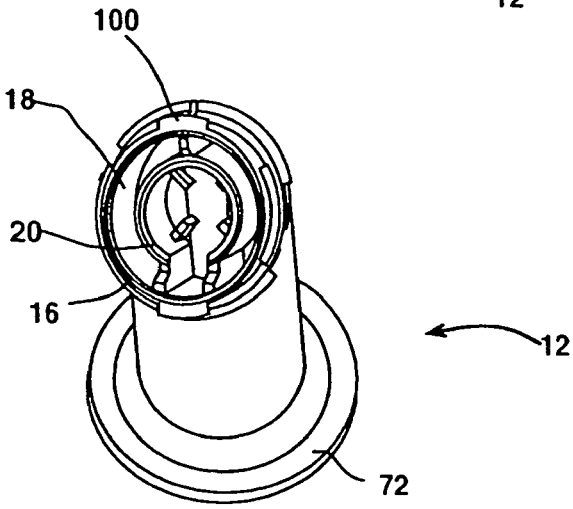
FIG. 4B is a perspective end view of the spout body shown in FIG. 4A.

Referring now to FIGS. 4 and 4A, 4B a variety of views of the spout body 12 portion of the present invention are shown. While in this embodiment the nozzle end 50 (shown in FIG. 5) and the spout body 12 are shown as being two pieces that can then be connected together to perform the function of the device. It is to be understood that this configuration is for manufacturing purposes and that to achieve the advantages of the presently claimed invention a variety of other modifications may also be utilized. This would include modifications where the nozzle end portion 50 and the spout body 12 were formed as a single piece.

Figure 5A:
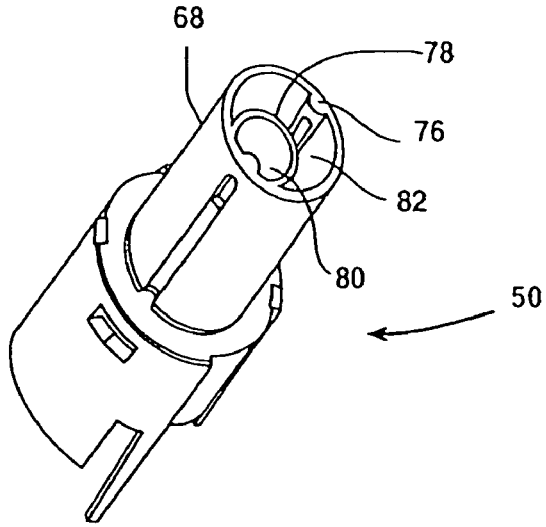
FIG. 5A is a side perspective view of the nozzle end portion of the present invention.
Figure 5B:
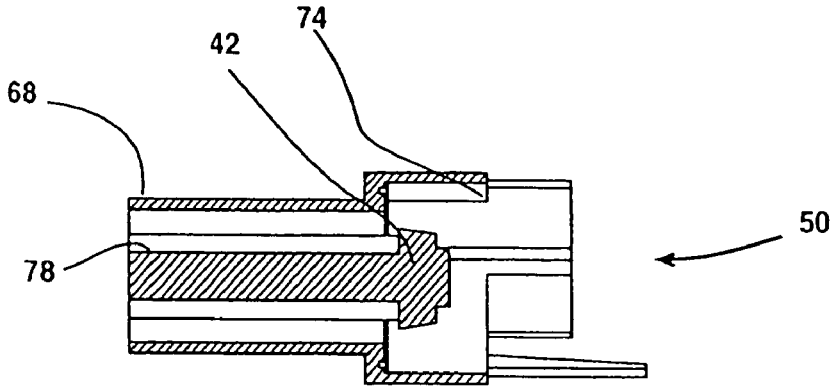
FIG. 5B is a cut away side view of the nozzle end portion of the present invention.
Figure 5C:
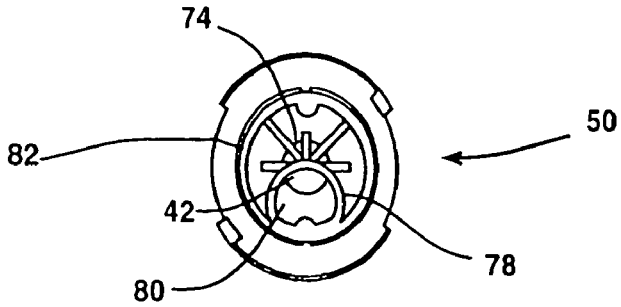
FIG. 5C is a front-end view of the nozzle end portion shown in FIG. 5.

FIGS. 5A, 5B, and 5C show the configuration of pieces that make up the nozzle end 50 of the present invention. These pieces connect to the spout body 12 and are configured make up the stopper portions 42 and the sealing ridge 74 described previously. Additionally, this device includes a partition 78 that divides the nozzle end into an airflow portion 80 and the liquid flow portion 82 sections. In order to assist with the proper alignment of the sliding sleeve 28 within the nozzle end portion 50 a series of alignment projections 76 are also included within the nozzle end 50.

In this preferred embodiment, the nozzle end 50 also include cradles 102 that impede the movement of the outer sheath 48 unless the sheath is appropriately twisted and pulled to remove the projections 100 on the outer sheath 48 from the cradle 102. The outer sheath 48 also has projections that are configured to interact with appropriately dimensioned portions of the spout body 12 and the nozzle end portion 50 to prevent the sheath from sliding and engaging the sliding clip 46. This provides the childproof and tamper proof feature of the present invention. While this configuration is shown as the configuration of the preferred embodiment. It is to be distinctly understood that the invention is not limited thereto but may variously embodied to include variously configured portions that achieve the results taught in this patent disclosure.

In the preferred embodiment, the open second end 68 of the nozzle end 50 is dimensioned to have a diameter of 0.8 inch. This size fits most fuel tanks. The combination of the invention provides a pour rate that is semi-adjustable depending upon the depression of the biasing spring and at full open the nozzle produces a flow that exceeds the two gallons per minute minimum flow rate requirement. The overall shape and length of the spout will accommodate a very high percentage of the application requirements for portable petroleum distillate storage containers.

Figure 6:
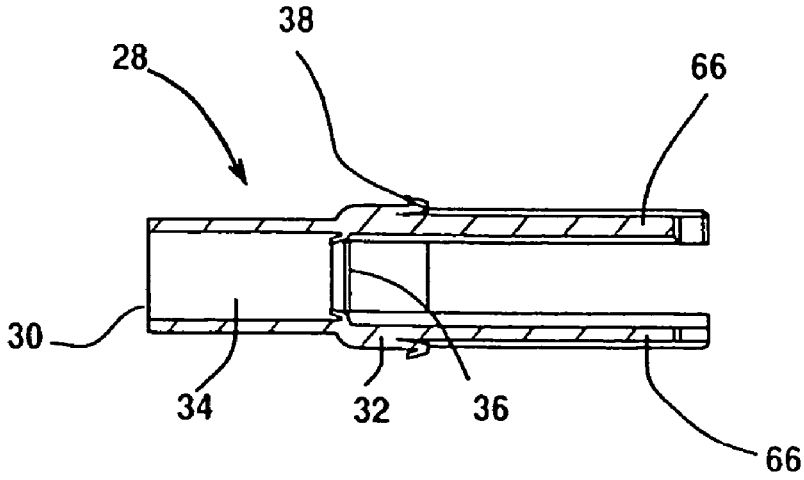
FIG. 6 is a cut away top view of the inner sleeve portion of the invention.
Figure 6A:
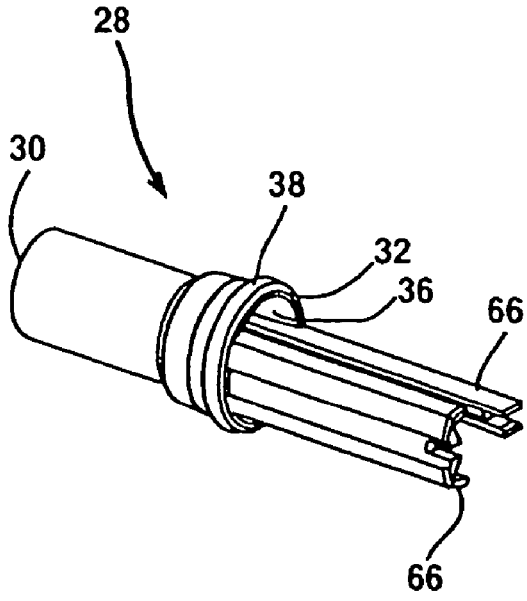
FIG. 6A is a side perspective view of the inner sleeve portion of the device.

Referring now to FIG. 6, several views of the sealing sleeve 28 are shown. In the preferred embodiment the sealing sleeve 28 configuration could be appropriately described as corolla having a variety of components extending from a central structure. The sealing sleeve 28 has a first end 30 extending to second end 32. Both the first and second ends 30, 32 of the sealing sleeve 28 are open to form a sealing sleeve passageway 34. Near the second end 32 of the sealing sleeve, a generally bell-shaped or campanulate portion 38 is configured to interact with a sealing portion 74 to prevent the flow of liquid through the spout body passageways 18. The inner portion of the sealing sleeve 28 near the portion of the bell-shaped second portion 30 is configured for sealing leak proof engagement with the stopper portion 42 of the end nozzle 50 as shown in FIG. 5. This prevents the passage of air into the device as well as preventing the flow of liquid out of the device. While the connection of the pedestal shaped stopper 42 are interchangeably variable to as to allow the opening and closing of the valve. The devices are configured so that the stopper 42 is generally never fully extracted from within the bell shaped portion 38 of the sliding sleeve 28.

The sealing sleeve 28 is configured to connect with projection portions 66 that extend into the nozzle end 50 and are configured to connect with a sliding clip 46. These projection portions 66 are configured to align with alignment portions 76 that are located within the nozzle end 50. These alignment portions 76 and the projection portions 66 are configured to align the sliding sleeve 28 in a designated orientation and position within the spout body 12 and the nozzle end 50. The alignment portions 76 also have a channel that is configured to have a space sufficient to allow the sliding clip 46 to fit into the outside of the end nozzle 50. The interface between these projections 66 and the rib shaped partition 78 further assist to isolate the flow of air from the flow of liquid that are flowing in opposite directions through the spout and the nozzle end.

These projections 66 also have connections to receive a portion of a sliding clip 46. This sliding clip 46 operates in conjunction with the outer sleeve 48 to selectively open and close the valve and the flow of material through the device. These projections 66 are configured to telescope and slide along a designated path. This telescoping arrangement allows the sliding sleeve 28 to be moved in a direction away from the second end 56 of the nozzle end connection 50. The configuration of the projections 66 and the partition 78 provide a telescoping half and half type of telescoping tube that prevents unimpeded air flow into the interior of the sliding sleeve 28, through the passageway 34 and up into the filling container. Several views of the sliding clip 46 are shown in the attached FIGS. 7A–7F.

Figure 8:
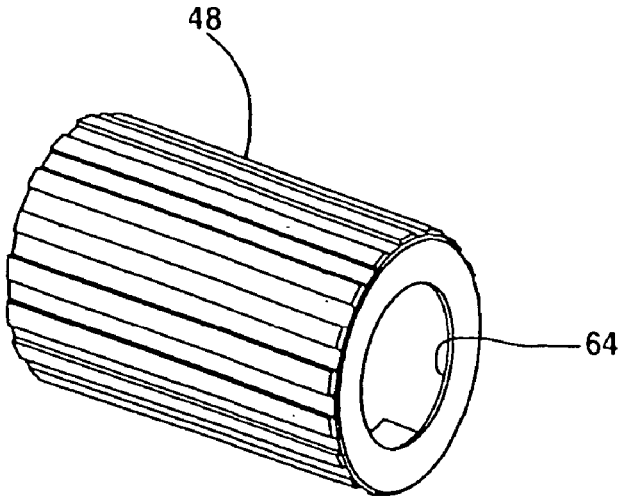
FIG. 8 is a perspective side view of the outer sheath portion of the present invention.
Figure 8A:
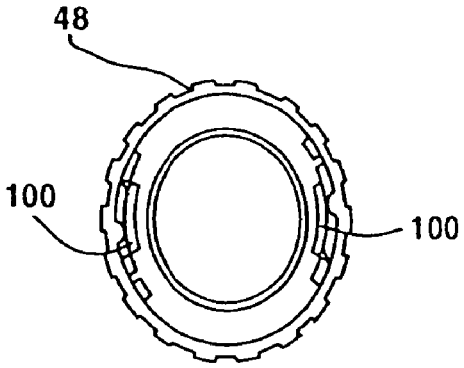
FIG. 8A is an end plan view of the outer sheath shown in FIG. 8
Figure 8B:
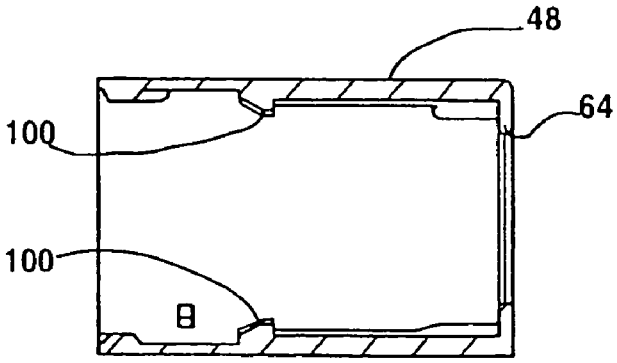
FIG. 8B is a cutaway side view of the outer sheath shown in FIG. 8A.

Referring now to FIGS. 8, 8A, and 8B, various views of the outer sheath 48 are shown. The outer sheath 48 is configured so that in the closed valve position (shown in FIG. 2) the sheath 48 is free from any demanded contact. When valve opening is desired, the outer sheath 48 must be twisted and pulled to allow the sheath in both a radial and a linear manner. Turning the sheath will disengage the child resist feature, allowing the sheath to be pulled back in a linear direction along the length of the spout body 12.

With a slight delay, as the movement passes the child resistant feature, the projections of the internal face of the sheath 64 engage the sliding clip 46 which in turn push back upon the projections 66 of the sliding sleeve 28. This movement can be accomplished by either a user twisting and pulling the sheath 48 back or by twisting the sheath 48 to the hold position, inverting the container, and pushing an outer portion of the sheath 48 against the lip of the receiving tank. When this occurs, the sliding sleeve 28 releases the connection between the campanate portion 38 of the sealing sleeve valve and the stopper 42 portion of the partition as well as the connection between the inner sealing surfaces 74 and the bell shaped connection portion of the sliding sleeve 38. When the pressure upon the outer sheath is released the biasing spring 44 pushes the sleeve 28 back up against the stopper 42 and the sealing portions, 74 and any further flow of material out of the device 10 is prevented.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A self-venting spout comprising:

an elongated spout housing comprising:

an open first end for connection to a container for liquid, an open second end for dispensing liquid, and an interior spout surface surrounding and defining an interior passageway extending between said open first end and open second end, a distal portion of the interior passageway having a longitudinal axis and a radial dimension;

a sealing ridge in said interior passageway near said interior spout surface, and a stopper generally centered in said interior passageway and radially distanced from said interior spout surface and from said sealing ridge; and a slidable sleeve in said interior passageway that is slidable parallel to said longitudinal axis, said slidable sleeve comprising a generally tubular portion having an outer surface with a first annular seal and an inner surface defining a sleeve passageway and having a second annular seal;

wherein, when said slidable sleeve is in a spout-closed position, said first annular seal contacts and seals against said sealing ridge of the spout housing, and said second annular seal contacts and seals against said stopper;

wherein, said spout comprises partition walls dividing said interior passageway into an air-flow passageway portion and a liquid-flow passageway portion, and wherein, when the slidable sleeve is in the spout-closed position, said sealing of the first annular sleeve and the sealing ridge blocks said liquid-flow passageway portion and said sealing of the second annular seal and the stopper blocks said air-flow passageway portion; and wherein, when said slidable sleeve is slid longitudinally to a spout-open position, said first annular seal is distanced from the sealing ridge to open said liquid-flow passageway portion and said second annular seal is distanced from the stopper to open said air-flow passageway portion.

2. A spout as in claim 1, further comprising:

an outer sheath that is slidable on said spout housing; and a clip that extends from near said outer sheath and through said spout housing and that engages said slidable sleeve;

said outer sheath being configured to engage said clip so that sliding said outer sheath longitudinally on the spout housing pulls the clip longitudinally to move the slidable sleeve from said spout-closed position to said spout-open position.

3. A spout as in claim 2, wherein said outer sheath is rotatable on the spout housing, and wherein said outer sheath is configured to be slidable along the spout housing only when the outer sheath is in one or more selected rotational positions.

4. A spout as in claim 1, wherein said spout housing comprises a body and a nozzle unit generally coaxially connected, wherein said nozzle unit comprises said sealing ridge and said stopper.

5. A spout as in claim 4, wherein said slidable sleeve has at least one longitudinal projection extending toward said second end, and wherein said nozzle unit is generally hollow and receives said longitudinal projection, said nozzle unit having at least one alignment protrusion extending radially inward toward, and engaging, said longitudinal projection.

6. A spout as in claim 2, wherein said spout housing comprises a body and a nozzle unit generally coaxially connected, wherein said nozzle unit comprises said sealing ridge and said stopper, and wherein said slidable sleeve has at least one longitudinal projection extending toward said second end, wherein said nozzle unit is generally hollow and receives said longitudinal projection, said nozzle unit having at least one alignment protrusion extending radially inward toward said longitudinal projection and engaging said projection; and wherein said clip connects to said at least one longitudinal projection for moving the slidable sleeve.

7. A spout as in claim 1, wherein the liquid-flow passageway portion comprises a proximal portion near said first end of the spout housing and a distal portion near said second end of the spout housing, wherein said distal portion is smaller in volume than said proximal portion for creating a venturi effect as the liquid flows through said liquid-flow passageway portion toward the second end.

8. A spout as in claim 1, wherein said spout housing has a proximal portion near said first end of the spout housing and a distal portion near said second end of the spout housing, and said proximal portion and distal portion are at an angle to each other.

9. A spout as in claim 1, wherein said air-flow passageway portion is defined near said spout housing first end by a generally tubular extension out from the spout housing that is configured to extend into the liquid container farther than the first end of the spout housing so that the pressure in the generally tubular extension is less than the pressure in the liquid-flow passageway portion at the first end of the spout housing.

10. A spout as in claim 1, wherein said first annular seal is a portion of a bell-shaped outer surface of said sleeve.

11. A spout as in claim 1, further comprising a spring received in said interior passageway, said spring configured to bias the slidable sleeve into the spout-closed position.

12. A self-venting spout comprising:

an elongated spout housing having an interior volume comprising an interior liquid-flow passageway and an interior air-flow passageway both extending between a first end of the spout housing and a second end of the spout housing, said air-flow passageway being generally centered on a longitudinal axis of the spout housing and said liquid-flow passageway radially offset from said air-flow passageway;

a stopper disposed in the air-flow passageway; and a sleeve slidably disposed in said interior volume and having an exterior surface defining a portion of said liquid-flow passageway and an interior surface defining a portion of said air-flow passageway, said sleeve further having a protruding first annular seal on said exterior surface and a protruding second annular seal on said interior surface;

wherein, when said sleeve is slid longitudinally to a closed-spout position, said first annular seal contacts and seals with a sealing ridge on said spout housing to seal closed the liquid-flow passageway to stop liquid from flowing from said first end to said second end of the spout housing, and said second annular seal contacts and seals to said stopper to seal closed the air-flow passageway to stop air from flowing from said second end to said first end of the spout housing; and wherein, when said sleeve is slid longitudinally to an open-spout position, said first annular seal is distanced from said sealing ridge to allow liquid to flow through the liquid-flow passageway past said first annular seal to said second end, and said second annular seal is distanced from the stopper to allow air to flow through the air-flow passageway past said second annular seal to the first end.

13. A spout as in claim 12, further comprising:

an outer sheath that is slidable on said spout housing; and an clip member that extends from near said outer sheath and through said spout housing and that engages said sleeve;

said outer sheath being configured to move the clip member longitudinally on the spout housing to slide the sleeve from said spout-closed position to said spout-open position.

14. A spout as in claim 12, wherein said outer sheath further is rotatable on the spout housing, and wherein said outer sheath is configured to be slidable along the spout housing only when the outer sheath is in one or more selected rotational positions.

15. A spout as in claim 12, comprising a body and a nozzle unit generally coaxially connected, wherein said nozzle unit comprises said sealing ridge and said stopper.

16. A spout as in claim 15, wherein said sleeve has at least one longitudinal projection extending toward said second end, and wherein said nozzle unit is generally hollow and receives said longitudinal projection, said nozzle unit having at least one alignment protrusion extending radially inward toward, and engaging, said longitudinal projection.

17. A spout as in claim 13, wherein the spout housing comprises a body and a nozzle unit generally coaxially connected, wherein said nozzle unit comprises said sealing ridge and said stopper, and wherein said sleeve has at least one longitudinal projection extending toward said second end, wherein said nozzle unit is generally hollow and receives said longitudinal projection, said nozzle unit having at least one alignment protrusion extending radially inward toward said longitudinal projection and engaging said projection; and wherein said clip member connects to said at least one longitudinal projection for moving the sleeve.

18. A spout as in claim 12, wherein the liquid-flow passageway portion comprises a proximal portion near said first end of the spout housing and a distal portion near said second end of the spout housing, wherein said distal portion is smaller in volume than said proximal portion creating a venturi effect as the liquid flows through said liquid-flow passageway portion toward the second end.

19. A spout as in claim 12, wherein said air-flow passageway is defined near said spout housing first end by a generally tubular extension out from the spout housing that is configured to extend into the liquid container farther than the first end of the spout housing so that the pressure in the generally tubular extension is less than the pressure in the liquid-flow passageway at the first end of the spout housing.

20. A spout as in claim 12, wherein said first annular seal is a portion of a bell-shaped outer surface of said sleeve.

21. A spout as in claim 12, further comprising a spring received in said interior passageway, said spring configured to bias the sleeve into the spout-closed position.

* * * * *